US007204728B2

(12) United States Patent
Noro et al.

(10) Patent No.: US 7,204,728 B2
(45) Date of Patent: Apr. 17, 2007

(54) TERMINAL FITTING AND A CONNECTOR PROVIDED THEREWITH

(75) Inventors: Yutaka Noro, Yokkaichi (JP); Ryotaro Ishikawa, Yokkaichi (JP); Hajime Kawase, Yokkaichi (JP); Keiichi Nakamura, Yokkaichi (JP); Yutaka Kobayashi, Yokkaichi (JP); Takahiro Yoneda, Sagamihara (JP); Ryo Sawada, Kawasaki (JP); Ken Yoshimura, Torrance, CA (US)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/345,586

(22) Filed: Feb. 1, 2006

(65) Prior Publication Data

US 2006/0172621 A1 Aug. 3, 2006

(30) Foreign Application Priority Data

Feb. 2, 2005 (JP) ..... 2005-026566

(51) Int. Cl.
*H01R 11/22* (2006.01)

(52) U.S. Cl. ..... 439/852; 439/851; 439/752.5

(58) Field of Classification Search ..... 439/852, 439/752.5, 851, 752.2
See application file for complete search history.

(56) References Cited

U.S. PATENT DOCUMENTS

| | | | | |
|---|---|---|---|---|
| 5,643,018 | A * | 7/1997 | Sakai et al. | 439/852 |
| 6,146,215 | A | 11/2000 | Matsushita et al. | |
| 6,227,915 | B1 * | 5/2001 | Sakatani et al. | 439/852 |
| 6,244,910 | B1 * | 6/2001 | Grubbs | 439/852 |
| 6,325,680 | B1 * | 12/2001 | Suzuki | 439/852 |
| 6,390,860 | B2 * | 5/2002 | Shirouzu et al. | 439/752.5 |
| 6,527,601 | B2 * | 3/2003 | Chen | 439/852 |
| 6,558,208 | B2 * | 5/2003 | Suzuki | 439/878 |
| 6,623,313 | B1 * | 9/2003 | Ichida et al. | 439/752.5 |
| 6,817,904 | B2 * | 11/2004 | Ishikawa et al. | 439/733.1 |
| 6,981,900 | B2 * | 1/2006 | Sakurai et al. | 439/752.5 |
| 2002/0081828 | A1 | 6/2002 | Tanaka | |

FOREIGN PATENT DOCUMENTS

JP 5-190227 7/1993

* cited by examiner

*Primary Examiner*—Hae Moon Hyeon
*Assistant Examiner*—Harshad C Patel
(74) *Attorney, Agent, or Firm*—Gerald E. Hespos; Anthony J. Casella

(57) ABSTRACT

A stabilizer (30) of a terminal fitting (20) is divided into a front stabilizer (31A) and a rear stabilizer (31B) and defining a small clearance therebetween. Thus, the smaller holes (32A, 32B) are formed by the divided stabilizer (30), and external matter is less likely to intrude.

18 Claims, 15 Drawing Sheets

TERMINAL FITTING AND A CONNECTOR PROVIDED THEREWITH

BACKGROUND OF THE INVENTION

1. Field of the Invention

The invention relates to a terminal fitting and to a connector provided therewith.

2. Description of the Related Art

Japanese Unexamined Patent Publication No. H05-190227 discloses a female terminal fitting with a rectangular tubular main portion and a resilient contact inside the main portion. The terminal fitting is secured to an end of a wire and is inserted into a cavity in a housing from behind. A stabilizer projects from a side plate of the main portion and is received in a guide groove in an inner wall of the cavity when the terminal fitting is oriented properly. Thus, the stabilizer and the guide groove prevent the terminal fitting from being inserted upside down and ensure a stable insertion of the terminal fitting.

There have been demands to reduce the heights of connectors in recent years and there has been a tendency to restrict the projecting heights of stabilizers. The stabilizer of an upside down terminal fitting contacts an opening edge at the entrance of the cavity where no guide groove is formed to hinder the insertion of the terminal fitting. However, a short stabilizer on an inverted terminal fitting can slip under the opening edge and the upside-down insertion of the terminal fitting is permitted, especially if the terminal fitting is inserted in an inclined posture.

A long stabilizer could be a countermeasure. However, the stabilizer typically is formed by making a cut in a side surface of the main portion and bending the cut portion. A long stabilizer would produce a large opening Terminal fittings are secured to ends of wires and the wires are bundled for transport. Thus, there is a likelihood that a stabilizer of another terminal fitting intrudes through an opening to get the wires entangled. Alternatively, external matter that intrudes through an opening can contact and deform a resilient contact inside the terminal fitting.

The invention was developed in view of the above problems, and an object thereof is to prevent the intrusion of external matter into an opening formed in the main portion of a terminal fitting.

SUMMARY OF THE INVENTION

The invention relates to a terminal fitting with a main portion. A plate of the main portion is cut and bent to form at least one stabilizer that extends substantially forward and backward along the inserting direction of the terminal fitting. The stabilizer is divided into a plurality of parts distanced from each other along forward and backward directions. As a result, separate and smaller openings are produced by the cutting and bending to form the stabilizer, even though the entire stabilizer is long. Thus, the stabilizers of other female terminal fitting and other external matter are unlikely to intrude through the openings. Accordingly, the terminal fittings and their wires are less likely to become entangled during transport. Furthermore, external matter is not likely to engage and plastically deform a resilient contact in the main portion.

The main portion preferably is a substantially polygonal tube and the respective divided parts of the stabilizer may be formed at different sides of the tubular main portion. The formation of the openings at different sides avoids an extreme reduction in the strength of one side. Thus, the entire main portion is strong and maintains a specified shape. Alternatively, the divided parts of the stabilizer may be formed at the same side of the main portion to ensure that the divided parts of the stabilizer are aligned properly in a row.

The divided parts of the stabilizer may be formed by cutting and bending the main portion so that a respective hole is left on the same side of the main portion with respect to the respective divided parts of the stabilizer.

The terminal fitting preferably is a female terminal fitting and the main portion preferably is a tube. A resilient contact is formed in the main portion and is configured to contact a mating male terminal fitting inserted into the main portion.

The resilient contact preferably extends from one longitudinal end of a plate of the tubular main portion and is folded back into the main portion so that a leading end of the resilient contact is in sliding engagement with the plate from which the resilient contact extends. This sliding engagement provides a second support for the resilient contact. The stabilizer preferably is cut and bent from the plate of the main portion from which the resilient contact extends. An area between the divided parts of the stabilizer preferably aligns with the leading end of the resilient contact. Thus, sufficient receiving strength is ensured for supporting the leading end of the resilient contact.

An inner wall preferably is provided at an inner side of an opening produced by the cutting and bending to form the stabilizer. The inner wall preferably is configured for at least partly closing the opening. Thus, the inner wall impedes intrusion of external matter through the opening.

At least one preventing portion preferably is provided in the main portion for limiting deflection of the resilient contact in a direction other than the deflection direction caused by the male terminal fitting during mating. Thus, the resilient contact is not likely to be damaged by unintended engagement.

The invention also relates to a connector with a housing having at least one cavity for receiving the above-described terminal fitting. At least one guide groove is formed in the cavity for receiving the stabilizer as the properly oriented terminal fitting is inserted into the cavity.

These and other features of the invention will become more apparent upon reading the following detailed description and accompanying drawings. Even though embodiments are described separately, single features thereof may be combined to additional embodiments.

BRIEF DESCRIPTIONS OF THE DRAWINGS

DETAILED DESCRIPTION OF THE PREFERRED EMBODIMENTS

Figure 10:
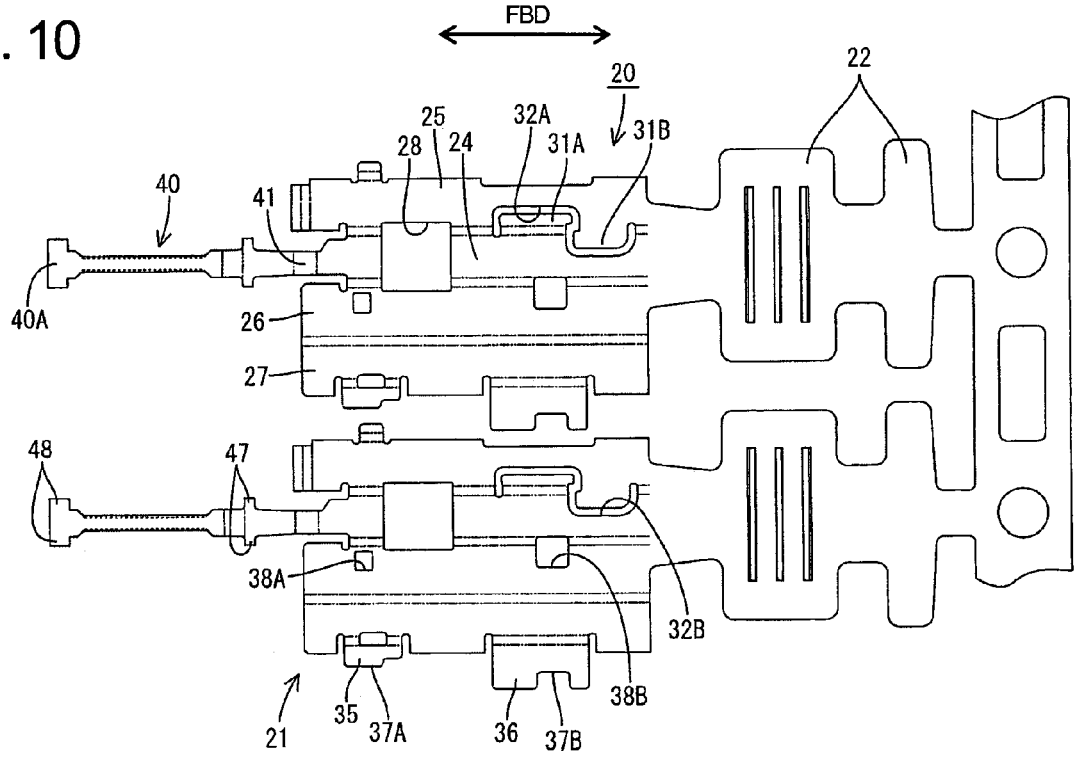
FIG. 10 is a development of the female terminal fitting.
Figure 11:
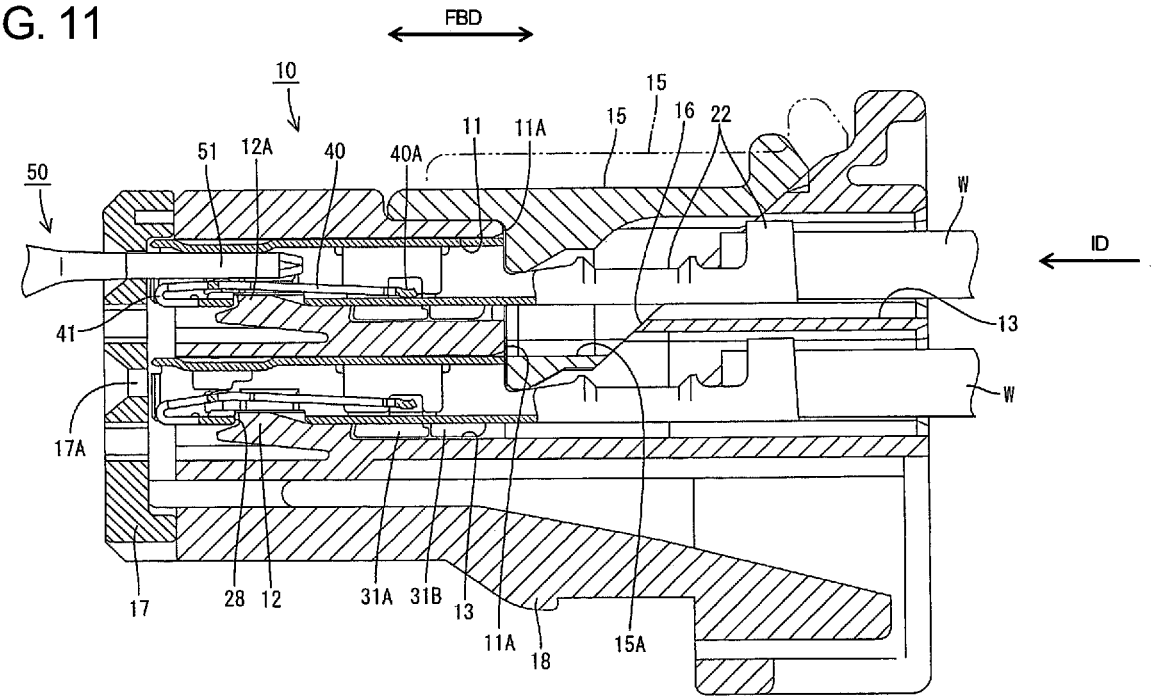
FIG. 11 is a longitudinal section of a connector housing into which the female terminal fittings are inserted.
Figure 12:
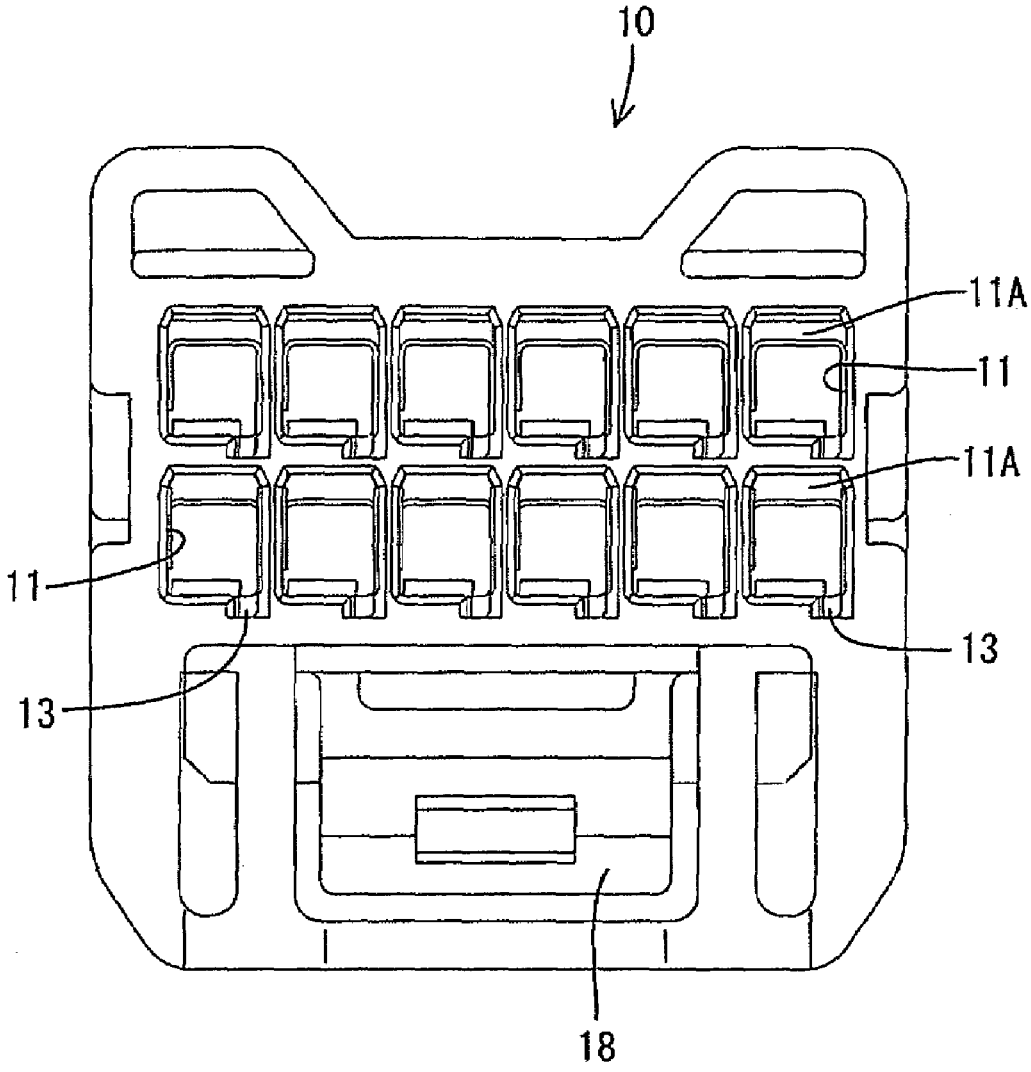
FIG. 12 is a rear view of the connector housing.
Figure 13:
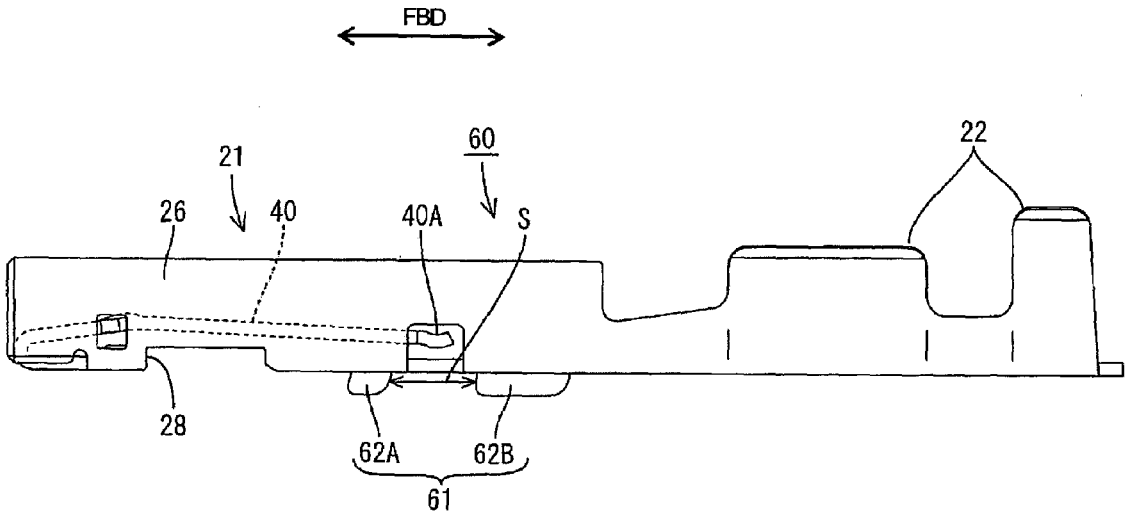
FIG. 13 is a right side view of a female terminal fitting according to a second embodiment.

A female terminal fitting in accordance with a first embodiment of the invention is identified by the numeral 20 in FIGS. 1 to 12. The female terminal fitting 20 is accommodated in a connector housing 10, as shown in FIGS. 11 and 12. The housing 10 is made e.g. of a synthetic resin and cavities 11 penetrate the housing 10 substantially in forward and backward directions FBD. A lock 12 cantilevers forward substantially along a bottom wall of each cavity 11. Further, a guide groove 13 is formed in each cavity 11 and extends substantially in forward and backward directions FBD along an inserting direction ID of the terminal fitting 20 into the cavity 11. The guide groove 13 is formed at the right side of the bottom wall of each cavity 11 and extends from the entrance of the cavity 11 to a position near the base end of the lock 12.

A retainer 15 for doubly locking the female terminal fittings 20 is mounted into an upper side of the housing 10 in FIG. 11, and a front plate 17 is to mounted on the front surface of the housing 10. Tabs 51 of male terminal fittings 50 mounted in an unillustrated mating male connector can enter the cavities 11 through tab insertion openings 17A of the front plate 17. A locking arm 18 is provided on the bottom of the housing 10 for locking the housing 10 and the mating male connector in their connected state.

Figure 1:
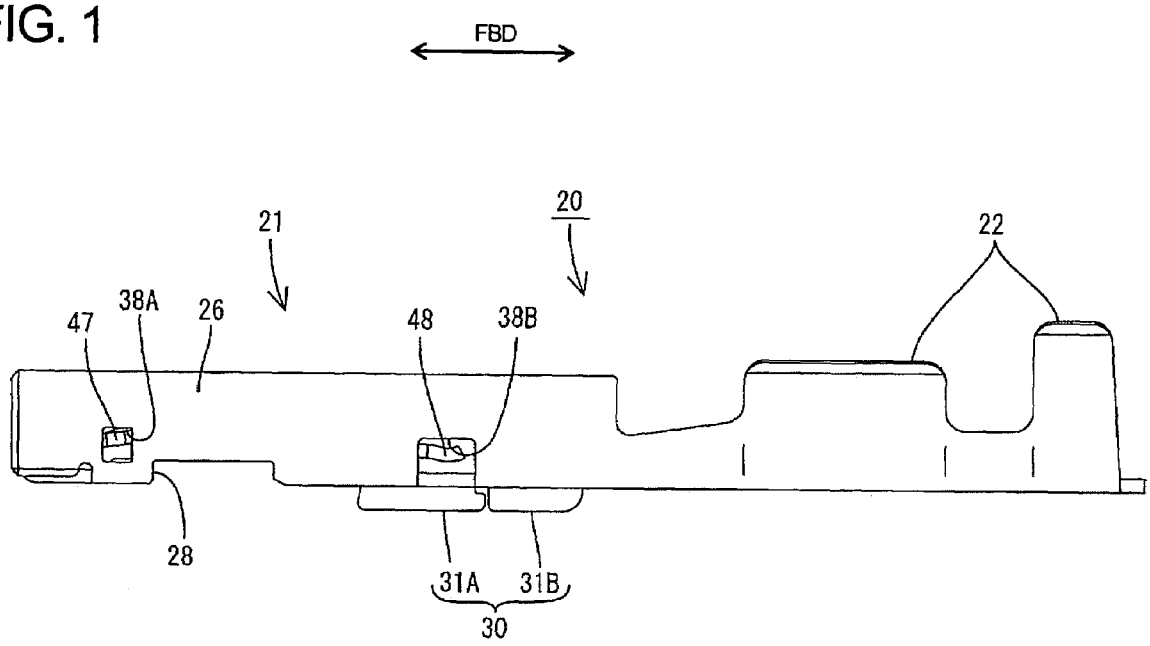
FIG. 1 is a right side view of a female terminal fitting according to a first embodiment of the invention.
Figure 2:
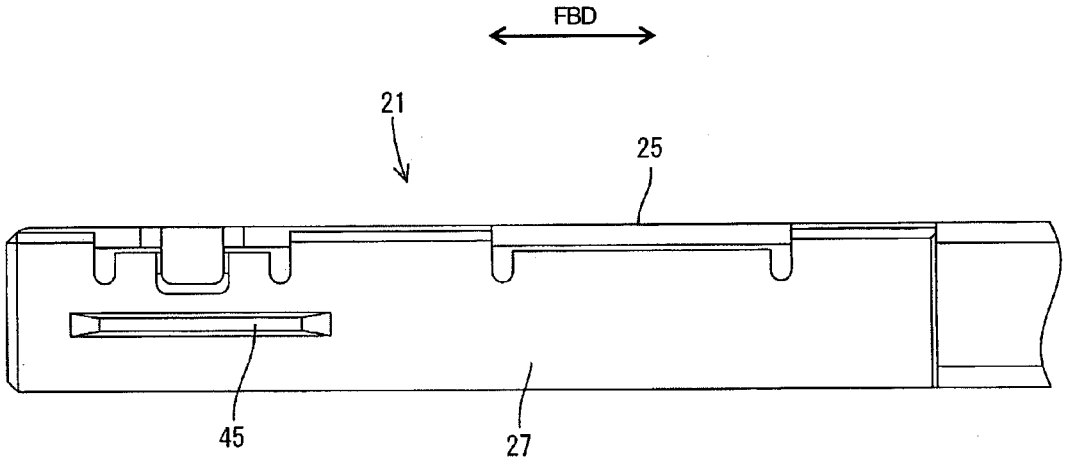
FIG. 2 is a plan view of a main portion of the female terminal fitting.

The female terminal fitting 20 is formed by bending, folding, embossing, stamping, pressing and/or cutting a conductive metal plate material stamped or cut out into a specified shape as shown in FIG. 10 and is narrow and long along forward and backward directions FBD. A rectangular tubular main portion 21 is formed at the front of the female terminal fitting 20 and a wire connecting portion 22 is formed at the rear of the female terminal fitting 20. The wire connecting portion 22 has open barrels, as shown in FIG. 1, that can be crimped, bent or folded into electrical connection with an end of a wire W (see FIG. 11).

The main portion 21 is hollow along forward and backward directions FBD and has a long narrow bottom plate narrow and long along forward and backward directions FBD, first and second side plates 25, 26 that project at substantially right angles from the left and right sides of the bottom plate 24, and a ceiling plate 27 that projects from substantially the entire projecting end of the right side plate 26 and extends towards the left side plate 25 and substantially parallel with the bottom plate 24.

A substantially rectangular locking hole 28 is formed over substantially the entire width of the bottom plate 24 at a position near the front end of the bottom plate 24. A locking edge 28A is formed at the front of the locking hole 28 and is engageable with a retaining projection 12A of the lock 12. This locking edge 28A is struck to project in by at least substantially the thickness of the base plate 24 to gain a larger engaging margin.

Figure 7:
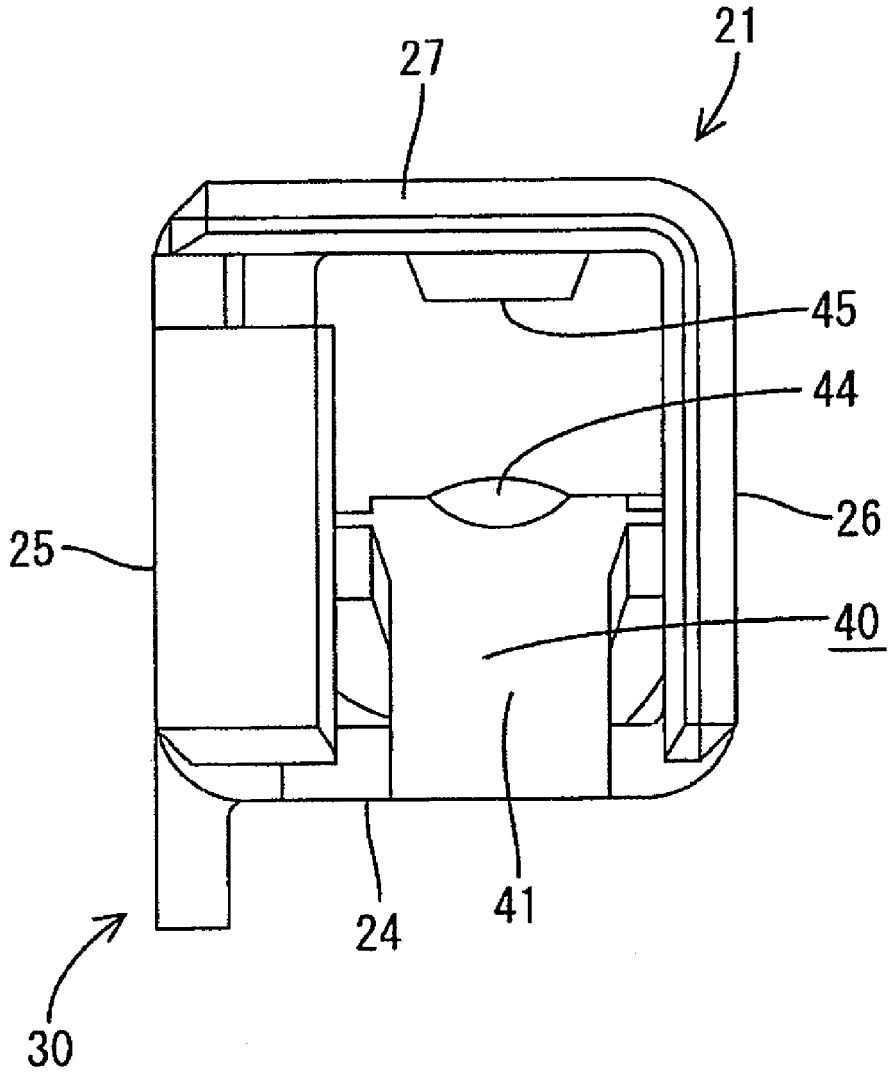
FIG. 7 is a front view of the female terminal fitting.

At least one stabilizer 30 projects out and down a specified distance from the left edge of the bottom plate 24, when viewed from the front, and is at a position on the main portion 21 behind the locking hole 28. The stabilizer 30 extends substantially along the forward and backward directions FBD, and is substantially flush with the left side plate 25, as shown in FIG. 7.

The stabilizer 30 is divided into a front stabilizer 31A and a rear stabilizer 31B with a small clearance therebetween. The front stabilizer 31A is slightly longer along the forward and backward directions FBD than the rear stabilizer 31B, and is formed by making at least one cut in the left side plate 25 and in the bottom 24 from the left edge of the bottom plate 24 and bending this cut portion at the bottom of the left side plate 25 to project down at substantially 90° from the bottom plate 24. A side hole 32A is formed in the left side plate 25 at a position where the cut portion is bent to form the front stabilizer 31A.

A cut is made in the bottom plate 24 from the corresponding bottom edge of the left side plate 25 to form the rear stabilizer 31B. This cut portion remains coplanar with the left side plate 25 and aligns substantially at a right angle to the bottom plate 24 as the left side plate 25 is bent substantially at right angle to the bottom plate 24 during the shaping of the main portion 21. Thus, the rear stabilizer 31 B projects from the left edge of the bottom plate 24. A bottom hole 32B is formed in the bottom plate 24 at a position where the cut portion is bent to form the rear stabilizer 31B.

Figure 3:
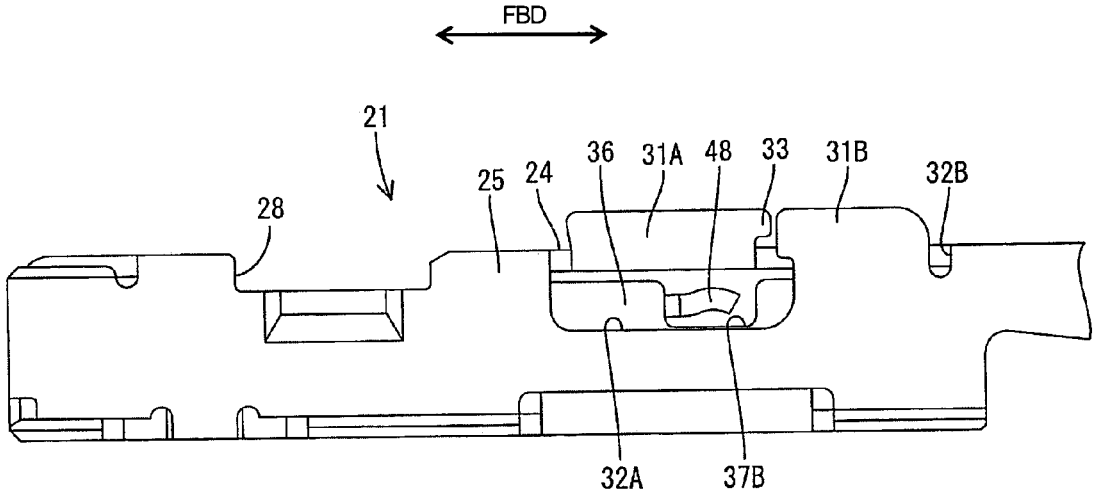
FIG. 3 is a left side view of the main portion.
Figure 4:
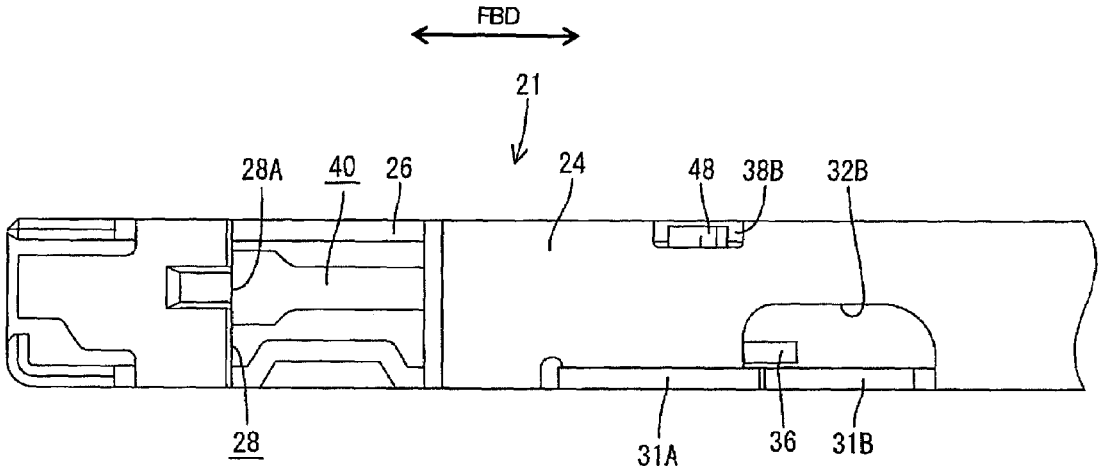
FIG. 4 is a bottom view of the main portion.

The front and rear stabilizers 31A, 31B substantially align with one another along the forward and backward directions FBD and project at substantially the same height, as shown in FIGS. 3 and 4. A narrowing portion 33 projects back from the rear edge of the front stabilizer 31A to narrow a spacing between the front and rear stabilizers 31A, 31B.

Front, rear and intermediate portions of an extending edge left edge of the ceiling plate 27 contacts the upper edge of the left side plate 25 from above. Front and rear inner plates 35, 36 extend down substantially normal to the ceiling plate 27 along the inner surface of the left side plate 25 at front and rear areas of the extending edge of the ceiling plate 27 that are not in contact with the upper edge of the left side plate 25.

The front inner plate 35 is substantially rectangular and has a bottom edge substantially at the center height of the main portion 21 to define a front preventing portion 37A. The rear inner plate 36 also has a rectangular shape, but is larger than the front inner plate 35. The rear inner plate 36 at least partly closes the side hole 32A produced by the cutting and bending to form the front stabilizer 31A. The bottom edge of the rear inner plate 36 is near the bottom plate 24, and a notch is formed at a position on the bottom edge shifted slightly towards the back. The upper edge of this notch defines a rear preventing portion 37B.

The right side plate 26 is formed with a substantially rectangular front locking hole 38A substantially corresponding to the front preventing portion 37A of the front inner plate 35 and a substantially rectangular rear locking hole 38B substantially corresponding to the rear preventing portion 37B of the rear inner plate 36.

Figure 6:
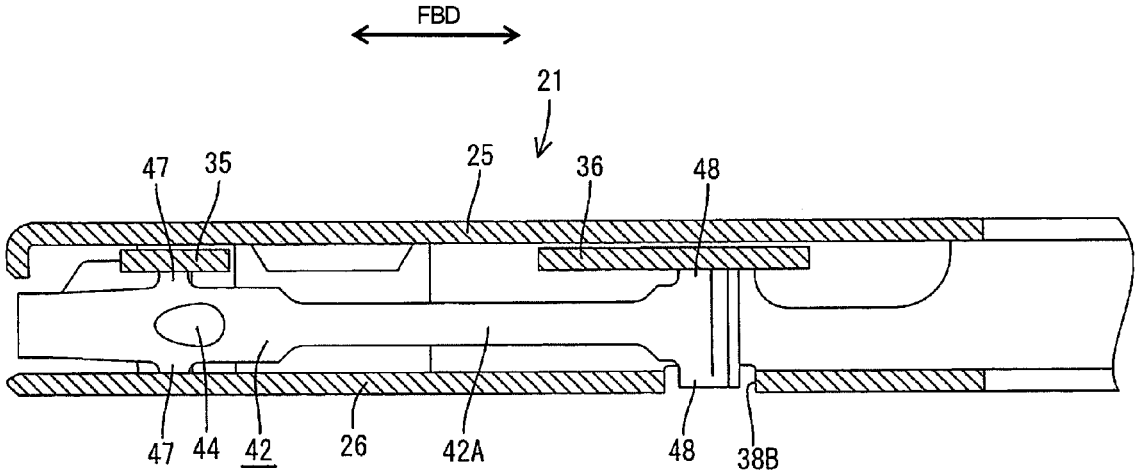
FIG. 6 is a section along VI—VI of FIG. 5.

A resilient contact 40 is accommodated in the main portion 21 and is configured for contacting the tab 51 of the mating male terminal fitting 50. The resilient contact 40 extends unitarily from the front end of the bottom plate 24 and is bent to cantilever backward. Additionally, the resilient contact 40 is narrow and long in forward and backward directions FBD. However, as shown in FIG. 6, the widthwise center of the resilient contact 40 is offset to the left when viewed from the front, and the widthwise center of the resilient contact 40 substantially coincides with the center of a spacing between the right side plate 26 and the inner plates 35, 36.

Figure 5:
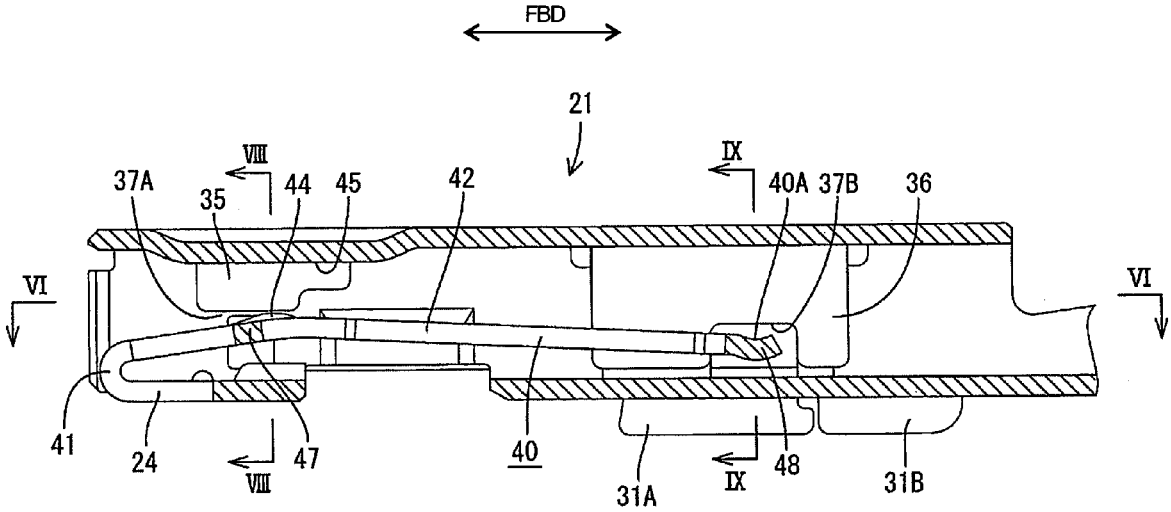
FIG. 5 is a longitudinal section of the main portion.

The resilient contact 40, as shown in FIG. 5, has a substantially arcuate bend 41 joined unitarily with the front end of the bottom plate 24 and an extending portion 42 extending from the bend 41 and moderately angled. In a free state, where the resilient contact 40 is not displaced, a free rear end 40A of the resilient contact 40 is distanced up from the bottom plate 24. Thus, the resilient contact 40 is supported only at the bend 41. The resilient contact 40 is resiliently displaceable up and down in a direction intersecting the inserting direction ID with at least the bend 41 as a supporting point while mainly bending the bend 41. The free end 40A of the resilient contact 40 contacts the inner surface of the bottom plate 24 when the resilient contact 40 is displaced down. Thus, the resilient contact 40 is supported at both front and rear ends.

A substantially dome-shaped contact point 44 is embossed substantially at the tip of the extending portion 42, and an area of the ceiling plate 27 corresponding to the contact point 44 is embossed to project down towards the resilient contact 40, thereby forming a tight holding portion 45. As shown in FIG. 6, an inclined portion 42A of the resilient contact 40 at a rear side of the extending portion 42 is narrower in a longitudinal middle part than at other parts.

Figure 8:
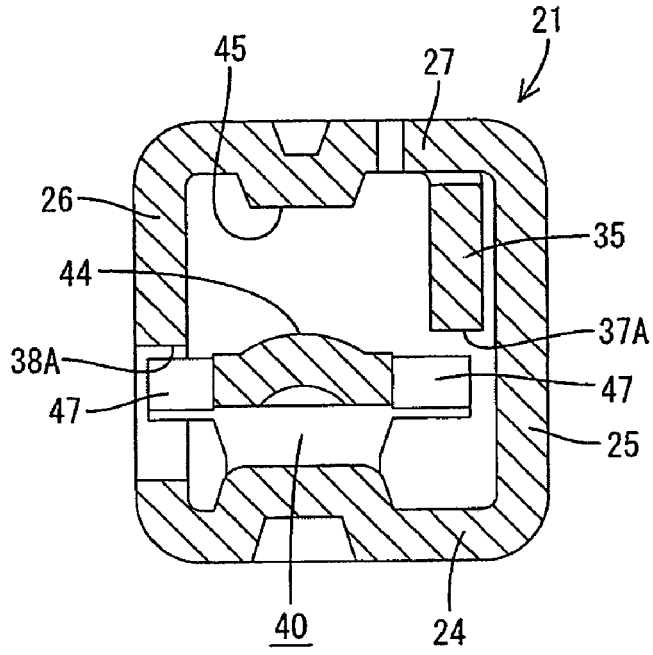
FIG. 8 is a section along VIII—VIII of FIG. 5.
Figure 9:
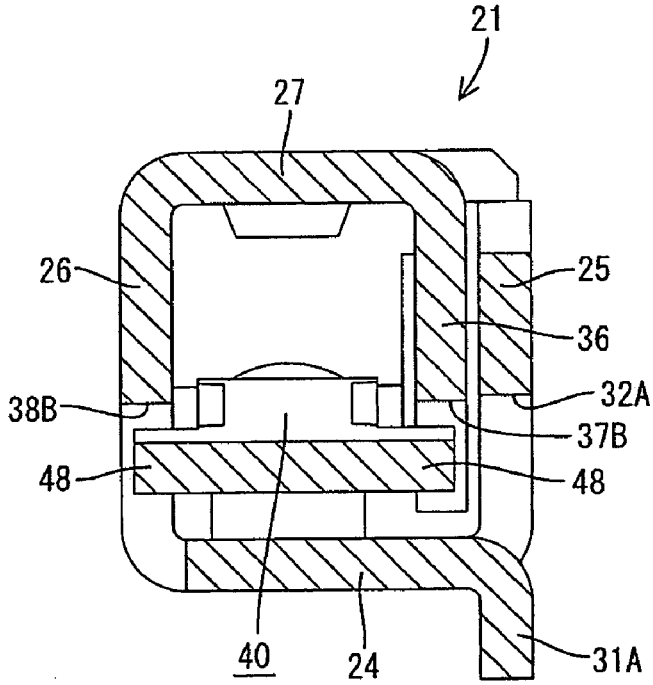
FIG. 9 is a section along IX—IX of FIG. 5.

Two front projections 47 and two rear projections 48 bulge out laterally from the left and right edges of the resilient contact 40, but are substantially flush with the resilient contact 40 in the thickness direction. The left and right front projections 47 are substantially symmetrical to each other and are slightly before the contact point 44. Additionally, the front projections 47 are located to correspond to the front preventing portion 37A of the front inner plate 35 and the front locking hole 38A of the right side plate 26 with respect to forward and backward directions FBD. In the free state where the resilient contact 40 is not resiliently displaced, the upper surfaces of the left and right front projections 47 are at non-contact positions slightly below the front preventing portion 37A and the upper edge of the front locking hole 38A corresponding thereto, as shown in FIG. 8.

The rear projections 48 are arranged at the free end 40A of the resilient contact 40. Additionally, the rear projections 48 are located to correspond to the rear preventing portion 37B of the rear inner plate 36 and the rear locking hole 38B of the right side plate 26 with respect to forward and backward directions FBD. In the free state, where the resilient contact 40 is not resiliently deformed, the upper surfaces of the left and right rear projections 48 are at non-contact positions slightly below the rear preventing portion 37B and the upper edge of the rear locking hole 38B corresponding thereto.

The female terminal fittings 20 are connected with the ends of the wires W by crimping the wire connecting portions 22. The stabilizer must have a long dimension along forward and backward directions FBD and must be formed by cutting and bending the main portion. Thus, a large hole could be formed in the main portion. However, in this embodiment, the front stabilizer 31A and the rear stabilizer 31B are formed separately by making cuts in different adjacent plates, namely the left side plate 25 and the bottom plate 24, and bending the cut portions. The combined length of the front and rear stabilizers 31A, 31B is sufficient to perform the required guiding and stabilizing function. However, the holes 32A, 32B produced in the different plates of the main portion 21 to form the front and rear stabilizers 31A, 31B are smaller than the hole that would have been produced to form a single stabilizer. Further, the rear inner plate 36 is at the inner side of the larger side hole 32A and at least partly closes this hole 32A.

The female terminal fittings 20 are connected with the ends of wires W and these assemblies of wires W and female terminal fittings 20 are bundled and transported to an operation site where the female terminal fittings 20 are inserted into the connector housing 10. As described above, the holes 32A, 32B produced by forming the stabilizers 31A, 31B are small and are in separate surfaces, i.e. the bottom plate 24 and the left side plate 25. Thus, stabilizer 30 of another of the bundled female terminal fittings 20 is less likely to enter the holes 32A, 32B and get entangled. The tab 51 of the mating male terminal fitting 50 or other external matter also is less likely to intrude. Therefore, the stabilizer, the tab 51 or other external matter is not likely to collide with and plastically deform the resilient contact 40 in the female terminal fitting 20.

The side hole 32A is larger than the bottom hole 32B, and hence has a higher probability of permitting the intrusion of external matter. Additionally, the side hole 32A is at a position to expose the free end 40 of the resilient contact piece 40. Thus, there is a possibility that the free end 40A may be deformed if external matter intrudes through the side hole 32A. However, the rear inner plate 36 at least partly closes the side hole 32A to prevent the intrusion of external matter through the side hole 32A.

The locking hole 28 also is relatively large, and there is a possibility that external matter could intrude and push the resilient contact 40 up. However, the front projections 47 can contact the front preventing portion 37A and the upper edge of the front locking hole 38A from below and the rear projections 48 can contact the rear preventing portion 37B and the upper edge of the rear locking hole 38B from below. Thus, upward deformation of the resilient contact 40 toward the insertion space for the tab 51 is limited. Further, the preventing portions 37A, 37B and the locking holes 38A, 38B are at front and rear positions behind the locking hole 28. Thus, there is no likelihood that the resilient contact 40 will incline forward or backward upon receiving a pressing force from external matter. This can prevent the bend 41, as a first supporting point of the resilient contact 40, from being plastically deformed.

The female terminal fittings 20 are inserted into the corresponding cavities 11 from behind and along the inserting direction ID while the retainer 15 is at the partial locking position shown in chain line in FIG. 11. The stabilizer 30 of the properly oriented female terminal fitting 20 faces down towards the guide groove 13. Thus, the female terminal fitting 20 is pushed and the stabilizer 30 is slid along the guide grooves 13, 15A in the wall of the cavity 11 where the lock 12 is provided and into the retainer 15.

The stabilizer 30 of an improperly oriented female terminal fitting 20 (e. g. upside down) contacts an edge 11A at the end of the cavity 11 to prevent any further insertion of the female terminal fitting 20. In this way, the improper (e.g. upside-down) insertion of the female terminal fitting 20 can be detected and prevented. The front of a stabilizer 30 of an improperly oriented female terminal fitting 20 might slip under the edge 11A that the stabilizer 30 is intended to contact if the female terminal fitting 20 is inclined down towards the front during insertion. However, the stabilizer 30 is long, and will bite in the inner wall of the cavity 11 at an early stage after having slipped under the edge 11A, thereby preventing any further insertion of the female terminal fitting 20 to securely detect and prevent the upside-down insertion.

The long stabilizer 30 of the properly oriented female terminal fitting 20 is guided along the guide groove 13. The length of the stabilizer 30 preferably is more than about one fourth, and more preferably greater than about one third of the longitudinal length of the main portion 21. The female terminal fitting 20 is pushed and resiliently deforming the lock 12 towards the final stage of the insertion and the lock 12 is restored resiliently up when the female terminal fitting 20 is inserted to a proper position. Thus, the retaining projection 12A enters the locking hole 28 and engages the locking edge 28A to lock the female terminal fitting 20. The retainer 15 then is pushed to the full locking position shown in solid line in FIG. 11, and the female terminal fittings are locked doubly so as not to come out.

The connector housing 10 is to be connected with the mating male connector after the female terminal fittings 20 are accommodated in the connector housing 10. Thus, the tabs 51 of the male terminal fittings 50 in the mating male connector are inserted through the tab insertion openings 17A of the front plate 17 and into the main portions 21 of the corresponding female terminal fittings 20 in the cavities 11. The tabs 51 move between the contact points 44 and the tightly holding portions 45 while resiliently displacing the resilient contacts 40, and are squeezed resiliently to electrically connect the female and male terminal fittings 20, 50.

As described above, the separate and smaller holes 32A, 32B are produced by forming the stabilizers 31A, 31B even though the stabilizer 30 is long as a whole. Thus, the stabilizers 30 of the other female terminal fittings 20 and other external matter are less likely to intrude through the holes 32A, 32B. As a result, the entanglement of the female terminal fittings 20 can be prevented such as when the wires W secured to the female terminal fittings 20 are bundled. Further, the plastic deformation of the resilient contact 40 provided in the main portion 21 due to a collision can be prevented.

In addition, the holes 32A, 32B are formed separately in adjacent plates of the main portion 21, particularly in the left side plate 25 and the bottom plate 24. Thus, external matter and the like are less likely to intrude and an extreme reduction in the strength of one surface can be avoided. Therefore the entire main portion 21 can be kept in shape with a larger strength.

A second embodiment of the invention is described with reference to FIGS. 13 to 16. A female terminal fitting 60 of the second embodiment is similar to the female terminal fitting 20 of the first embodiment in that a stabilizer 61 is divided into a front part and a rear part, but differs therefrom in the shape. Hereinafter, points of difference are described while reference is made to the description relating to the first embodiment for the similarities.

A front stabilizer 62A and a rear stabilizer 62B project down a specified distance substantially normal to the bottom plate 24 and substantially flush with the left side plate 25 at a specified distance S from each other along forward and backward directions FBD and at positions behind the locking hole 28 of the main portion 21. The front stabilizer 62A is slightly longer than a projecting distance thereof, the rear stabilizer 62B is longer than the front stabilizer 62A, preferably a little longer than twice the length of the front stabilizer 62A. A spacing S between the two stabilizers 62A, 62B substantially corresponds to the length of the rear stabilizer 62B. The position of an area 64 between the two stabilizers 62A, 62B with respect to forward and backward directions FBD substantially corresponds to the position of the free end 40A of the resilient contact 40.

Cuts are made in the bottom plate 24 from the bottom edge of the left side plate 25. Portions defines by the cuts align at an angle of substantially 90° to the bottom plate 24 as the left side plate 25 is bent at a right angle to the bottom plate 24 upon forming the main portion 21. Thus, the front and rear stabilizers 62A, 62B project from the left side of the bottom or base plate 24. Front and rear holes 63A, 63B are produced at positions on the bottom plate 24 where the front and rear stabilizers 62A, 62B are formed. The area 64 between the two stabilizers 62A, 62B substantially corresponds to the free end 40A of the resilient contact 40, as described above, and the bottom plate 24 remains over the entire distance between the two holes 63A, 63B, as shown in FIG. 15.

Figure 14:
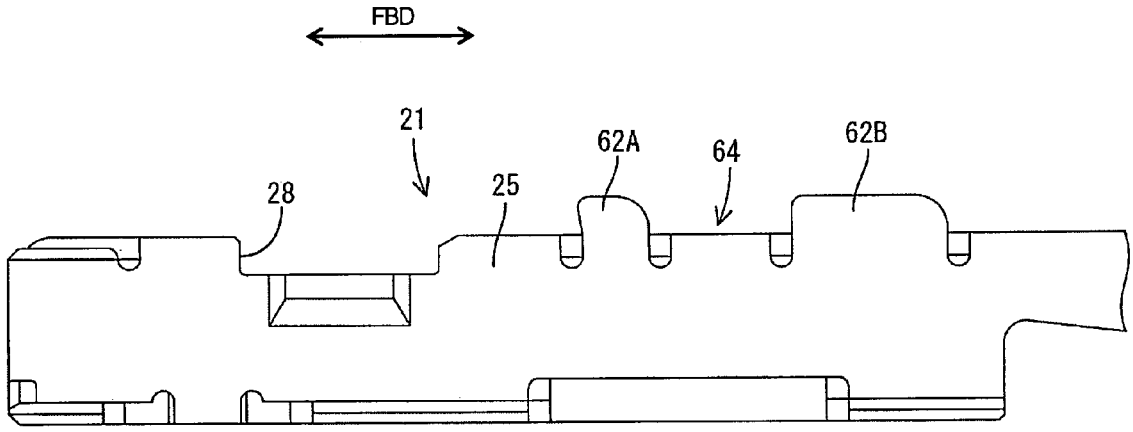
FIG. 14 is a left side view of a main portion.
Figure 15:
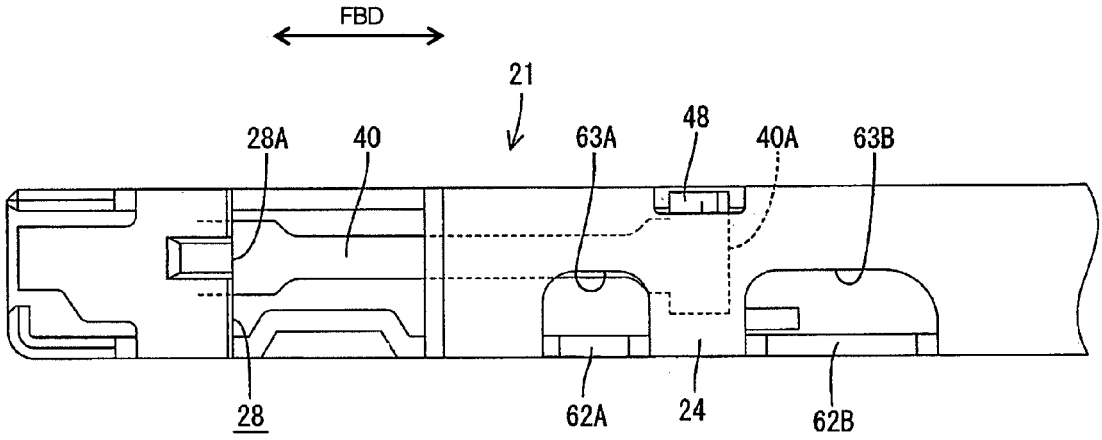
FIG. 15 is bottom view of the main portion.
Figure 16:
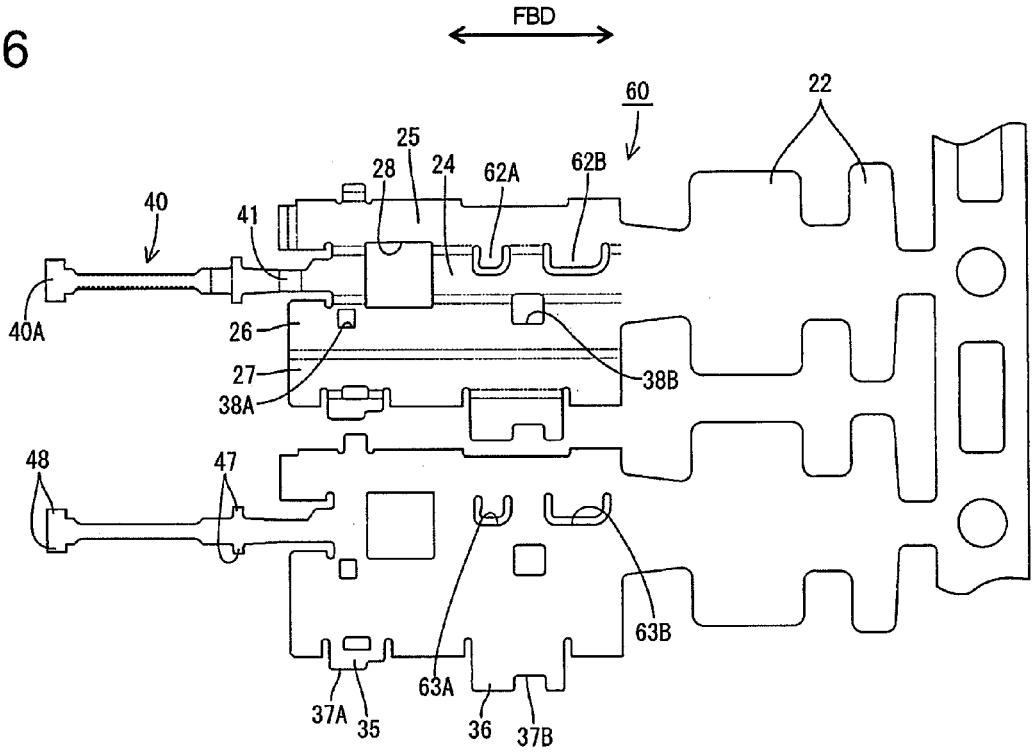
FIG. 16 is a development of the female terminal fitting.

The front stabilizer 62A and the rear stabilizer 62B are aligned at the same projecting height and at a specified distance S from each other along forward and backward directions FBD, as shown in FIGS. 14 and 15.

The other construction is similar to or same as the first embodiment, and no repeated description is given by identifying parts having the similar or same functions by the same reference numerals.

The holes 63A, 63B produced by forming the stabilizer 61 of the second embodiment are separate and small holes even though the stabilizer 61 is long as a whole. Thus, the stabilizers of other terminal fittings and other external matter are not likely to intrude through the holes 63A, 63B.

The front and rear stabilizers 62A, 62B are formed from the same plate of the main portion 21, namely the bottom plate 24, and are not bent themselves. Thus, the front and rear stabilizers 62A, 62B can be formed easily to align in a row along the forward and backward directions FBD.

Both stabilizers 62A, 62B are formed from the bottom plate 24 of the main portion 21 and leave the holes 63A, 63B. However, the bottom plate 24 is left in a wide range without making any hole at a portion corresponding to the free end 40A of the resilient contact 40, which is a second supporting point of the resilient contact 40, by letting the position of the area 64 between the two stabilizers 62A, 62B correspond to the free end 40A of the resilient contact 40. As a result, a sufficient receiving strength can be ensured upon bringing the free end 40A of the resilient contact 40 into contact, whereby the free end 40A can securely fulfill its function as the second supporting point. In addition, the free end 40A of the resilient contact 40 can be hidden from the outside, thereby being prevented from being plastically deformed due to the collision of an external matter or the like.

The invention is not limited to the above described and illustrated embodiments. For example, the following embodiment is also embraced by the technical scope of the present invention as defined by the claims. Beside the following embodiment, various changes can be made without departing from the scope and spirit of the present invention as defined by the claims.

The stabilizer may be divided into three or more parts. The more the stabilizer is divided into, the more unlikely external matter are to intrude since holes produced upon forming the stabilizer can be made smaller.

The surface(s) from which the stabilizer is formed can be suitably selected depending on conditions such as the standing position of the stabilizer and the position of the resilient contact piece.

The invention is not limited to the female terminal fittings illustrated in the foregoing embodiments, and is also applicable to male terminal fittings provided with one or more stabilizers.

The shape of the main portion of the terminal fitting is not limited to a rectangular tubular shape illustrated in the foregoing embodiments and may be an other shape such as a cylindrical shape or a polygonal shape.

The present invention may be also applied to terminal fittings having two or more groups of stabilizers, wherein at least part of these groups of stabilizers may be divided into two or more parts, the groups of stabilizers being particularly provided at different circumferential positions (when seen from front) or edges of the terminal fittings, particularly of the main portions thereof.

What is claimed is:

1. A terminal fitting, comprising a substantially rectangular tubular main portion having opposite front and rear ends spaced along forward and backward directions, and substantially planar front and rear stabilizers projecting out on the main portion so that planes defined by the front and rear stabilizers are aligned substantially parallel to the forward and backward directions, the front and rear stabilizers being distanced from each other along the forward and backward directions, one of the stabilizers being cut from a first side plate of the main portion and being disposed in substantially coplanar alignment with a second side plate of the main portion that extends angularly from the first side plate of the main portion.

2. The terminal fitting of claim 1, wherein the front stabilizer extends unitarily from the first side plates of the main portion and the rear stabilizer extends unitarily from the second side plates of the main portion.

3. The terminal fitting of claim 1, wherein the front and rear stabilizers extend unitarily from the same side plate of the main portion.

4. The terminal fitting of claim 3, wherein the front and rear stabilizers are formed by cutting and bending a plate of the main portion such that holes are left in the main portion on the same side of the main portion with respect to the front and rear stabilizers.

5. The terminal fitting of claim 1, further comprising a resilient contact in the main portion for contacting a mating male terminal fitting inserted into the main portion from the front end.

6. The terminal fitting of claim 5, wherein an area between the front and rear stabilizers substantially aligns with a leading end of the resilient contact.

7. The terminal fitting of claim 6, wherein the resilient contact extends from an end of the first plate and is folded back into the main portion, and the leading end of the resilient contact being disposed for sliding contact with the first plate.

8. The terminal fitting of claim 5, further comprising an inner wall at an inner side of an opening produced in the main portion to form the stabilizers, the inner wall being configured for at least partly closing the opening.

9. The terminal fitting of claim 5, further comprising at least one preventing portion in the main portion for limiting deflection of the resilient contact in a direction other than a deflection direction caused by the mating male terminal fitting inserted into the main portion from the front.

10. The terminal fitting of claim 1, wherein the front and rear stabilizers are substantially coplanar with one of said side plates.

11. The terminal fitting of claim 10, wherein the substantially rectangular tubular main portion has first and second opposed substantially parallel side plates and opposed substantially parallel top and bottom plates extending between the side plates, one of the stabilizers being substantially unitary and coplanar with the first side plate, the other of these stabilizers being substantially unitary with the bottom plate and bent to be substantially coplanar with the first side plate.

12. A connector comprising;

a housing having at least one cavity, a guide groove being formed in the cavity and extending along forward and backward direction; and at least one terminal fitting insertable into the cavity, the terminal fitting having a substantially tubular main portion with opposite front and rear ends spaced along the forward and backward directions, and front and rear stabilizers projecting out on the main portion, the front and rear stabilizers being substantially coplanar and aligned substantially along the forward and backward directions and being configured for insertion into the guide groove when the terminal fitting is inserted into the cavity, the front and rear stabilizers being distanced from each other along the forward and backward directions at least one of the stabilizers being formed by cutting a first side plate of the main portion so that the stabilizer projects from the main portion in substantially coplanar alignment with a second side plate that extends angularly from the first side plate of the main portion.

13. The connector of claim 12, wherein the main portion is a substantially polygonal tube having a plurality of side plates, the front stabilizer being formed to extend unitarily from the first side plates of the main portion and the rear stabilizer being formed to extend unitary from second side plates of the main portion.

14. The connector of claim 12, wherein the main portion is a substantially polygonal tube having a plurality of side plates, the front and rear stabilizers extending unitarily from the same side plate of the main portion.

15. The connector of claim 12, further comprising a resilient contact in the main portion for contacting a mating male terminal fitting inserted into the main portion from the front end.

16. The connector of claim 15, wherein an area between the front and rear stabilizers substantially aligns with a leading end of the resilient contact.

17. The connector of claim 15, wherein the resilient contact extends from an end of the first plate and being folded back into the main portion, and the leading end of the resilient contact being disposed for sliding contact with the first plate.

18. A connector comprising:

a housing having at least one cavity, a guide groove being formed in the cavity and extending along forward and backward directions; and at least one terminal fitting insertable into the cavity, the terminal fitting having a substantially rectangular tubular main portion with opposite front and rear ends spaced along the forward and backward directions, the substantially rectangular tubular main portion having first and second opposed substantially parallel side plates and opposed substantially parallel top and bottom plates extending between the side plates, front and rear stabilizers projecting out on the main portion, the front and rear stabilizers being substantially coplanar and aligned substantially along the forward and backward directions for insertion into the guide groove when the terminal fitting is inserted into the cavity, the front and rear stabilizers being distanced from each other along the forward and backward directions, one of the stabilizers being substantially unitary and coplanar with the first side plate, the other of the stabilizers being substantially unitary with the bottom plate and bent to be substantially coplanar with the first side plate.

* * * * *